US005321942A

United States Patent [19]

Hartness

[11] Patent Number: 5,321,942

[45] Date of Patent: Jun. 21, 1994

[54] METHOD AND APPARATUS FOR DIRECTING CONDITIONED AIR TO A SPINNING MACHINE

[75] Inventor: Roy Hartness, Charlotte, N.C.

[73] Assignee: Pneumafil Corporation, Charlotte, N.C.

[21] Appl. No.: 982,910

[22] Filed: Nov. 30, 1992

[51] Int. Cl.[5] ..... D01H 4/22

[52] U.S. Cl. ..... 57/301; 57/304; 57/308

[58] Field of Search ..... 57/300, 301, 302, 304, 57/308, 406, 411, 415

[56] References Cited

U.S. PATENT DOCUMENTS

| | | | |
|---|---|---|---|
| 2,425,578 | 8/1947 | Thoma et al. | 57/308 |
| 2,924,062 | 2/1960 | Sutcliffe | 57/308 X |
| 2,946,173 | 7/1960 | Bahnson | 57/308 X |
| 4,265,278 | 5/1981 | Jassniker . | |
| 4,357,793 | 11/1982 | Gasser et al. | 57/90 X |
| 4,570,682 | 2/1986 | Bachmann . | |
| 4,628,677 | 12/1986 | Turner et al. | 57/301 |
| 5,157,910 | 10/1992 | Artzt et al. | 57/308 |

FOREIGN PATENT DOCUMENTS

| | | | |
|---|---|---|---|
| 4109110 | 9/1992 | Fed. Rep. of Germany | 57/308 |

*Primary Examiner*—Joseph J. Hail, III

*Attorney, Agent, or Firm*—Shefte, Pinckney & Sawyer

[57] ABSTRACT

A spinning machine, preferably an open end spinning machine, having a conduit associated therewith for distributing a flow of conditioned air along a predetermined flow path in which the conditioned air is caused to flow in a direction directly toward and across the rapidly rotating, heat-generating element (e.g., a rotor disposed in a spin box), with a portion of the conditioned air flowing in and around the rapidly rotating element to absorb heat from the same, and with another portion of the conditioned air flowing across the length of fibers fed to the spinning machine and across the yarn produced at the spinning machine to moisturize the length of fibers and yarn. A return duct is located above the spinning machine and has a negative pressure created therein for causing the conditioned air, after it has absorbed heat from the rotating element and conditioned the length of fibers and the yarn, to flow upwardly from the spinning machine and entrain microdust and similar particulate matter therein and the conditioned air is then received by the return duct.

1 Claim, 4 Drawing Sheets

METHOD AND APPARATUS FOR DIRECTING CONDITIONED AIR TO A SPINNING MACHINE

BACKGROUND OF THE INVENTION

In modern textile yarn forming operations, it is well known that the quality of the yarn produced is dependent to a large extent on the condition of the ambient air in which the yarn is formed. For example, in textile yarn spinning machines, both open end and ring spinning machines, the humidity and temperature of the ambient air must be carefully controlled within predetermined limits to improve the quality of the yarn and reduce the tendency of the yarn to break in subsequent processing steps such as knitting and weaving operation.

One conventional method of dealing with this problem is to carefully monitor and control the temperature and humidity of the air that is circulated through the entire area in which the textile equipment is operating, such as a spinning room in which a large number of spinning machines are operating. While this method of circulating conditioned air serves to improve the quality of the yarn, it is relatively inefficient because the entire volume of air in a large room must pass through air conditioning equipment having high energy operating demands.

It is also known to introduce the conditioned air at a point beneath a weaving machine rather than generally to the weaving room itself. For example, in Bachmann U.S. Pat. No. 4,570,682, conditioned air is introduced into the weaving room through small apertures so that thin and gentle jets of conditioned air are freely directed into the space beneath the weaving machines and in Jassniker U.S. Pat. No. 4,265,278, conditioned air is introduced into the weaving room through a first opening in a duct extending along the floor of the weaving room and through a second duct opening directing the conditioned air into the interior of the weaving machine below the weaving plane. This patent also indicates that some of conditioned air may be withdrawn through a return duct disposed within the weaving machine itself or through an additional conditioning faculty disposed in the ceiling of the weaving room.

However, spinning machines as compared to weaving machines, present a somewhat different problem, namely, dissipating the substantial quantity of heat that is generated by the spinning apparatus itself. Thus, in open end spinning machines, a rapidly rotatable rotor housed in a spin box is provided, and a continuous length of fiber is introduced and broken down into individual fibers so that the fibers can be formed into a length of yarn by the rotor, and the yarn is then directed to a cone or spool for collection thereon. As open end spinning machine technology advances, the rotating speed of the rotor increases and the frictional and operational heat generated thereby also increases. Similarly, in ring spinning machines, the increasing rotational speeds of the spindles and the traveler generate increased heat which creates problems if it is not properly dealt with.

SUMMARY OF THE INVENTION

In accordance with the present invention, a method and apparatus are provided for directing conditioned air to a spinning machine in a manner that effectively and efficiently deals with the heat generated at particular portions of the spinning machine where such heat is generated (e.g., at the spin box), and that simultaneously conditions the yarn produced by the spinning machine, all in an energy efficient manner that significantly reduces the energy cost required to accomplish these tasks.

More specifically, in the preferred embodiment of the present invention, a textile spinning machine having an arrangement for forming a continuous length of fiber into a yarn is provided, with the yarn forming arrangement including a rapidly rotatable apparatus through which the fiber is passed and at which a significant amount of heat is generated. The improvement comprises a conduit device positioned on the spinning machine to receive conditioned air from a source and to direct the conditioned air along a predetermined flow path in which the conditioned air is caused to flow in the direction directly toward and across the heat generating rotatable apparatus, the continuous length of fiber, and the formed yarn to thereby dissipate heat from the apparatus and simultaneously condition the yarn being formed thereby, and a return duct is preferably positioned directly above the spinning machine and provided with a negative pressure therein for causing the conditioned air, now heated and at least partially demoisturized by its passage over the apparatus and the length of fiber and the yarn, to flow in an upward direction from the spinning machine to be collected in the return duct.

Where the spinning machine is an open end spinning machine, the conduit arrangement of the present invention is positioned to cause the conditioned air to flow in a direction that will cause a portion of the conditioned air to pass over the spin box itself to dissipate heat from the spin box, and will cause another portion to be directed over the sliver entering the spin box and the yarn exiting the spin box to condition such sliver and yarn. Preferably, the conditioned air is also directed in a manner that will result in a portion of the conditioned air actually passing into the spin box and the rotor through openings in the spin box.

DESCRIPTION OF THE PREFERRED EMBODIMENT

Figure 1:
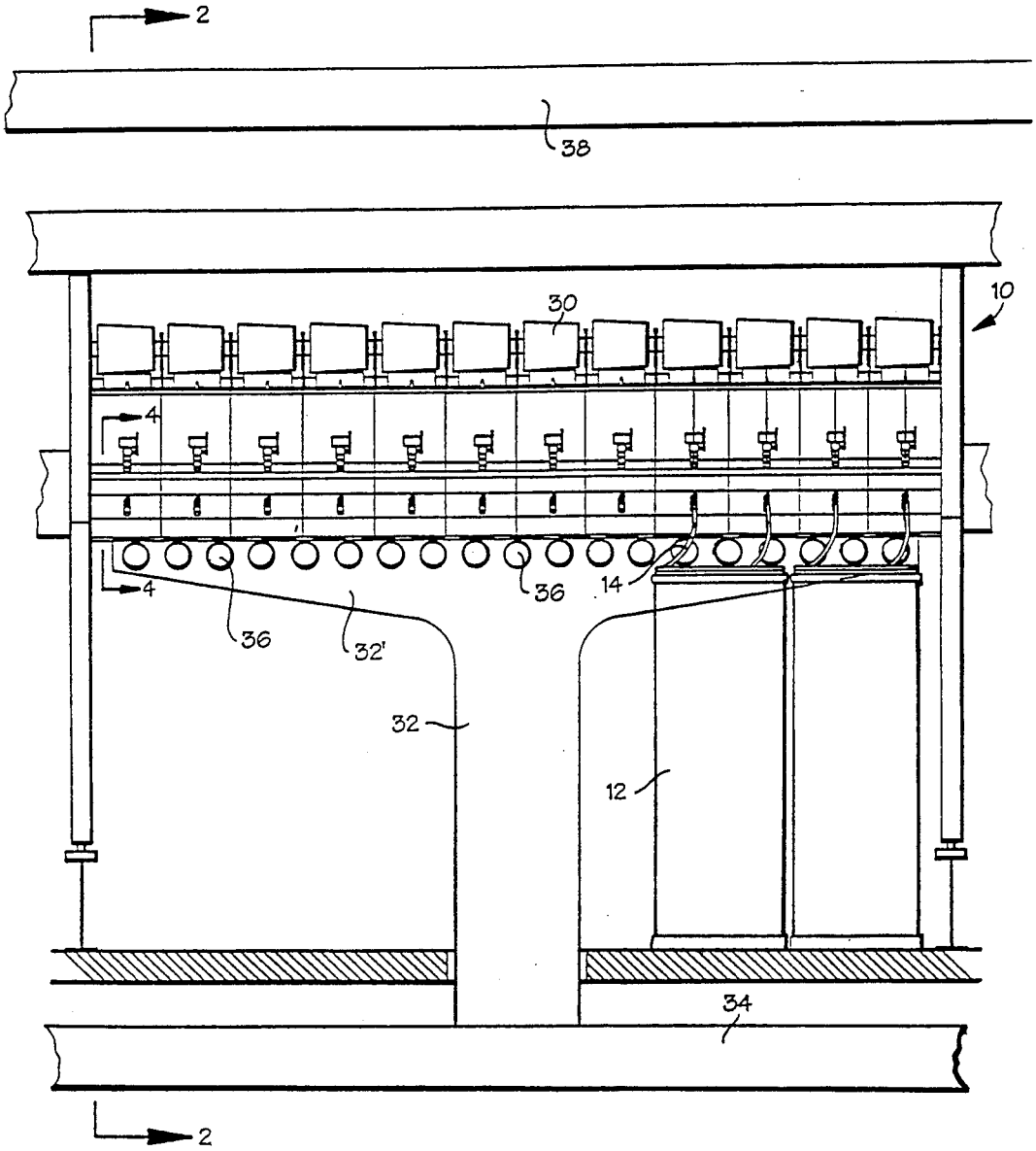
FIG. 1 is a front elevational view of a conventional open end spinning machine having installed therewith the improvement of the present invention.

Looking now in greater detail at the accompanying drawings, FIGS. 1–4 illustrate a typical open end spinning machine 10 having the conditioned air improvement of the present invention associated therewith. The illustrated open end spinning machine 10 is entirely conventional and is representative of a variety of spinning machines to which the present invention is applicable. The spinning machine 10 includes a plurality of spinning positions, each of which includes a sliver can 12 from which a continuous length 14 of loose fibers, generally referred to as a sliver, is fed through a sliver inlet fitting 16 to a sliver opening unit 18 in which the sliver 14 is opened and broken down into individual fibers in a well-known manner, and these fibers are then caused to pass through a fiber conduit (not shown) to a spin box generally indicated by the reference numeral 20. Within the spin box 20 is a rapidly rotatable rotor 21 driven by a drive shaft 22 (see FIG. 4) to form the fibers into a yarn 24 which passes outwardly from the spin box 20 through a withdrawal tube 26, after which it passes over a yarn guide 28 and is wound onto a cone or spool 30. As indicated above, all of the components of the representative open end spinning machine 10 illustrated in the drawings are conventional, and it is to be noted that the rapidly rotating rotor 21 generates a significant amount of heat at each one of the large number of spinning positions which, unless properly controlled, will adversely affect the temperature and humidity of the ambient air. Moreover, if the yarn 24 is formed from cotton or a cotton blend, the heat generated by the rotor 21 will cause the exiting yarn 24 to be very dry and increase the possibility of breakage of the yarn as it passes through further processing steps such as knitting or weaving of the yarn.

Figure 2:
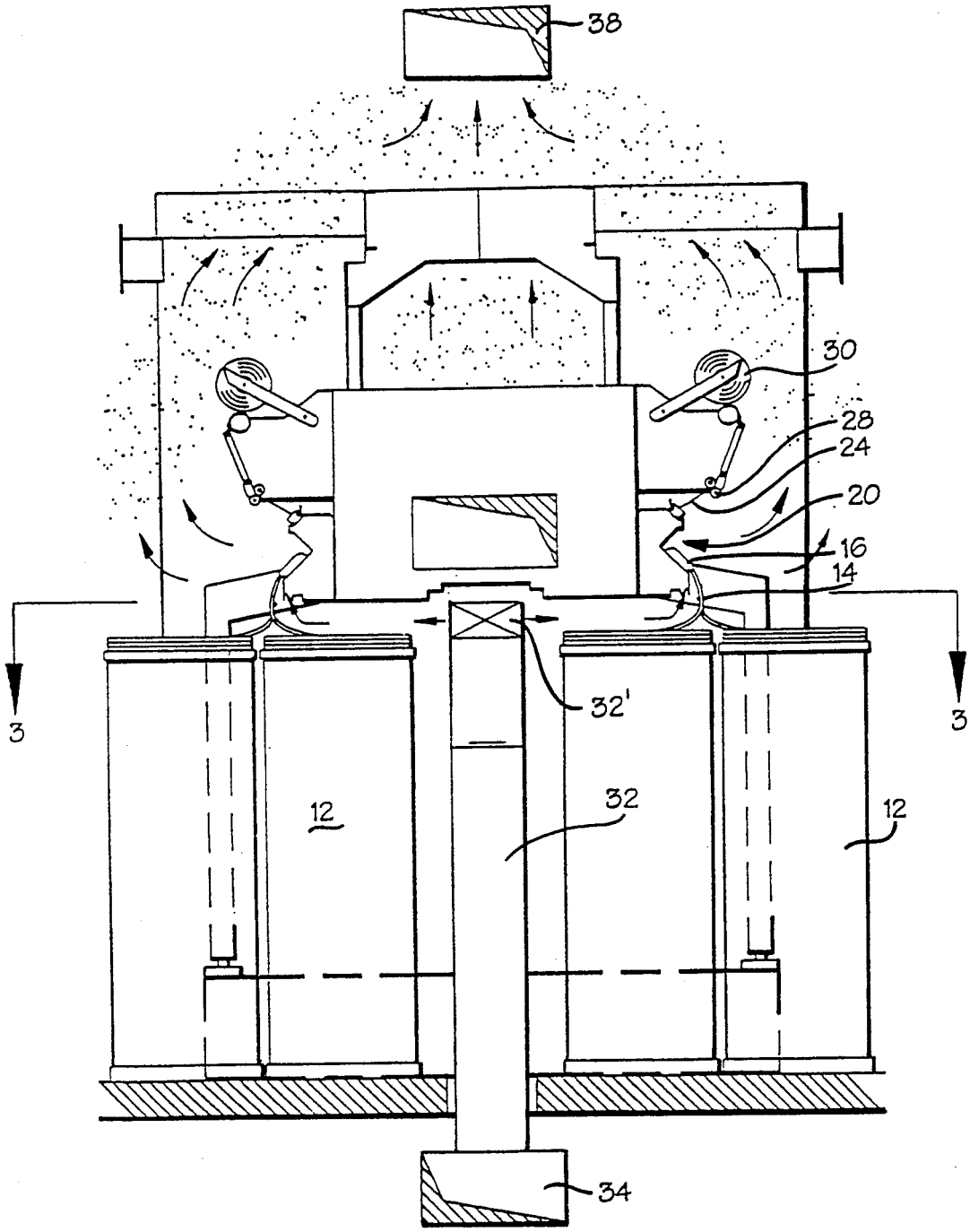
FIG. 2 is a sectional view taken along line 2—2 in FIG. 1.
Figure 3:
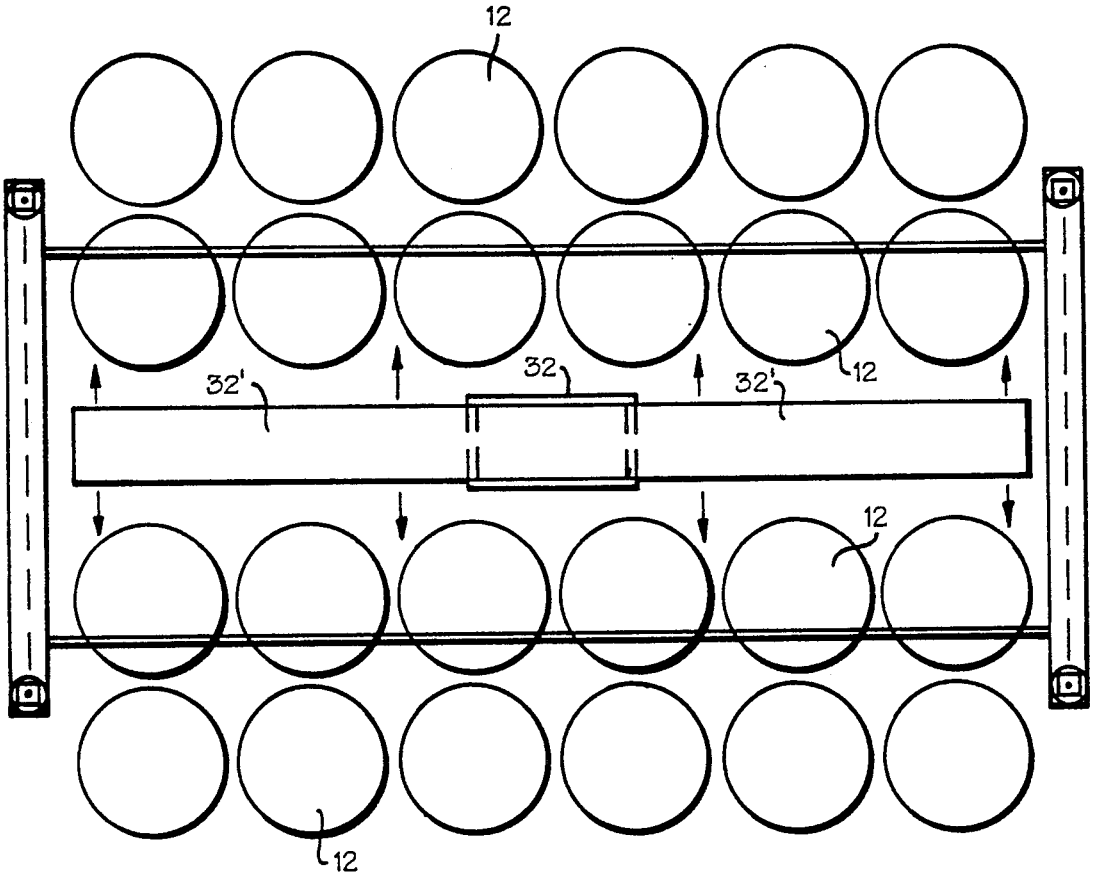
FIG. 3 is a sectional view taken along line 3—3 in FIG. 2.

In accordance with the present invention, each open end spinning machine 10 is provided with a conduit or air duct 32 positioned on the spinning machine 10 to receive conditioned air from any convenient source, such as a supply air duct 34 which can be located in the floor of spinning rooms. The upper end of the conduit 32 has a horizontally extending reach 32' that is positioned centrally of the open end spinning machine between the spinning positions on each side thereof as best seen in FIGS. 2 and 3, and the conduit portion 32' is provided with a plurality of openings 36 from which conditioned air passes from the conduit portion 32' in a direction generally indicated by the arrows in FIGS. 2 and 3. The conduit portion 32' and the openings 36 therein are positioned with respect to the spinning machine 10 and the plurality of spinning positions thereof so as to direct the exiting conditioned air along a predetermined flow path in which the conditioned air is caused to flow in a direction directly toward and across the hot spin box 20, across the sliver 14 and across the yarn 24 exiting from the spin box 20 to utilize the cool, moisture-bearing conditioned air to simultaneously control the heat generated at the spin box 20 and at any related elements which generate any significant amount of heat, and to add moisture to the sliver 14 and the yarn 24 as it leaves the withdrawal tube 26, all in a manner to be described in more detail below.

After removing heat from the spin box 20 and adding moisture to the sliver 14 and yarn 24, the conditioned air is caused to flow upwardly to a return duct 38 located directly above the spinning machine 10, the return duct 38 being provided with a negative pressure therein for causing the conditioned air, now carrying the heat removed from the spin box and now devoid of some of its moisture, to flow in an upward direction from the spinning machine and to be collected in the return duct as indicated by the flow arrows in FIG. 2.

The positioning of the conduit 32 and its horizontal reach 32' combines with the negative pressure created at the return duct to cause the conditioned air to first flow over the exterior surfaces of the spin box 20 and related elements and then to pass over the sliver 14 and the yarn 24, as described above, and this conditioned air is then caused to flow upwardly away from the spinning machine and toward the return duct 38 so that the conditioned air, in addition to performing its heat absorption and conditioning functions as described above, also serves to entrain microdust and other small particulate matter that is commonly generated as a result of the yarn handling components over which the yarn 24 passes after it leaves the withdrawal tube 26. Accordingly, while most, if not all, conventional open end spinning machines have internal suction conduits as described below, which take away microdust and the like that is generated internally (e.g., within the spin box 20), the present invention provides an additional advantage by effectively entraining microdust and the like generated externally (e.g., downstream of the withdrawal tube 26), and carrying it away in an upward direction, thereby substantially reducing the exposure of workmen and operators working in the vicinity of the spinning machines 10 to the well-known harmful affects of microdust and related particulate matter.

Figure 4:
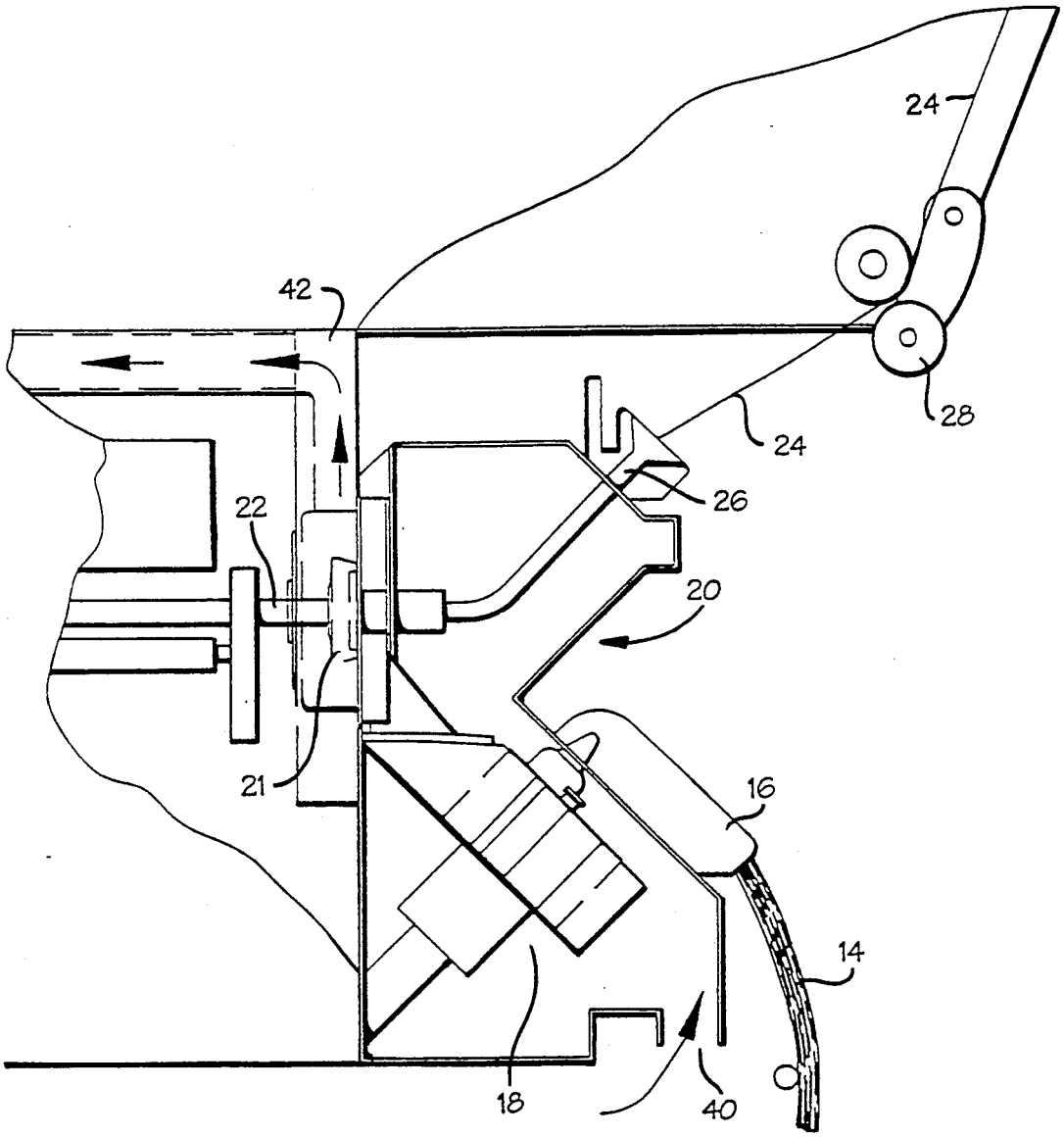
FIG. 4 is a detailed sectional view taken along line 4—4 in FIG. 1 illustrating the flow of the conditioned air through the spin box of the open end spinning machine illustrated in FIGS. 1–3.

Moreover, since the conditioned air is specifically directed toward the spin box 20, the conditioned air, in accordance with a further feature of the present invention, also passes directly into the interior of the spin box 20 in the manner that is diagrammatically illustrated in FIG. 4. More particularly, the inlet fitting 16 of the spin box 20 includes an opening through which the sliver 14 passes into the spin box 20 and a second opening is provided at the end of the withdrawal tube 26 through which the yarn 24 formed by the spin box 20 exits. Typically, spin boxes include additional openings in the structural components thereof, such as the opening 40 illustrated in FIG. 4, and, also typically, open end spinning machines are provided with a suction conduit 42 from which air passing through the spin box 20 is carried away from the spin box 20 in a conventional manner. The present invention takes advantage of this existing condition in typical spinning machines by directing conditioned air along a flow path that will ensure that a portion of the conditioned air will actually flow into the spin box 20 and through openings in the spin box housing, such as opening 40, whereby the cooling effect of the conditioned air is not only applied at the exterior surfaces of the spin box 20 and spin box housing, it is also applied at the interior thereof and at the rotor 21 as well.

It will be apparent from the above that the present invention offers a significant number of important advantages as compared with known spinning machines. First, and perhaps most importantly, the present invention utilizes conditioned air in an extremely efficient manner. More specifically, the conditioned air is initially directed to the point where it is most needed (e.g., directly to the spin box 20, where the sliver enters the spin box 20, and where the dry yarn leaves the spin box 20) so that the conditioned air is at its coolest and most moist condition when it passes over the hottest portion of the spinning machine and when it passes over the sliver and yarn in their driest state, thereby maximizing the heat exchange effect and moisturizing effect of the conditioned air relative to the spin box 20 and the yarn. Additionally, after the conditioned air is heated and to some extent demoisturized by its passage over the spin box 20, the sliver 14, and the yarn 24, the present invention takes advantage of the natural tendency of the heated air to flow upwardly toward the return duct 38, thereby reducing to some extent the low pressure requirements for the return duct 38, and this upward air flow also tends to remove some of the heat generated by lights, the spinning machine, and other heat generating sources located in the ceiling prior to that heat being liberated generally into the spinning room. Finally, and importantly, the conditioned air in the present invention is introduced at the spinning machine itself and immediately directed to the points where it is most needed (e.g., at the spin box 20, at the sliver 14, and at the exiting yarn 24) while such air is in a condition that is most conducive to carrying out its heat absorbing and moisturizing function, all of which significantly improve the efficiency by which the functions are carried out, and, therefore, as compared with conventional spinning room air conditioning systems in which conditioned air is introduced generally into the entire spinning room, proper cooling of the spin box and conditioning of the yarn formed thereby can be obtained using substantially less conditioned air at a corresponding energy cost savings. For example, in a typical conventional spinning room environment, approximately 10,000 CFM of conditioned air is required to maintain the environment surrounding a 216 rotor frame at desired temperature of 70° F. and at a desired 62% relative humidity. It is believed, but not yet confirmed, that the present invention will reduce the required quantity of conditioned air by almost one-half, which will obviously reduce significantly the equipment and energy costs associated with creating the required conditioned air.

While the present invention has particular application in connection with open end spinning machines, it may also be used with conventional ring spinning machines, in which case the conduit 32 would be positioned to direct the conditioned air directly across the spindles, and the rings and rapidly rotating travelers thereon which generate substantial amounts of heat as yarn is formed, and directs the conditioned air across the continuous length of fiber (roving) fed to the spinning machine and across the formed yarn itself, all in a manner generally similar to that described above in connection with a typical open end spinning machine.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In combination with an open end spinning machine having a plurality of rapidly rotating rotors, each of which is disposed in a spin box formed with openings therein, including a first opening through which a continuous length of fiber enters said spin box and a second opening from which a continuous length of yarn emerges from said spin box, and a source of conditioned air, the improvement comprising:

a) conduit means extending from said source of conditioned air and along said plurality of spin boxes, said conduit means including a first vertical extending portion connected at one end to said source of conditioned air and connected at its other end to a second horizontally extending portion that is positioned centrally of said open end spinning machine and directly between adjacent and opposite ones of said rapidly rotating rotors, said second conduit portion of said conduit means having a pluralilty of outlet openings therein formed in said second conduit portion to direct said conditioned air along a predetermined flow path in which said conditioned air is caused to flow first in a horizontal direction directly toward and across said spin box, with a first portion of said conditioned air being directed to flow into said spin box through at least some of said openings therein, to thereby absorb heat from said spin box and said rotor therein with a portion of said conditioned air being directed to flow across said length of fiber introduced into said spin box to condition said length of fibers, and with a portion of said conditioned air being directed to flow across said yarn after it leaves said spin box; and b) a return duct having a negative pressure created therein and means positioned above said open end spinning machine relative to said second conduit portion to change the direction of said first horizontal flow path of conditioned air by drawing said horizontally flowing air upwardly across said oppositely adjacent rotating rotor and said yarn emerging therefrom.

* * * * *